US006007062A

United States Patent [19]

Choo et al.

[11] Patent Number: 6,007,062

[45] Date of Patent: Dec. 28, 1999

[54] METHOD AND APPARATUS FOR REMOVING A JAMMED PAPER FROM AN INK-JET PRINTER

[75] Inventors: Jong-Yang Choo, Seoul; Jin-Ho Park, Kyonggi-do, both of Rep. of Korea

[73] Assignee: SamSung Electronics Co., Ltd., Kyungki-do, Rep. of Korea

[21] Appl. No.: 08/840,692

[22] Filed: Apr. 25, 1997

[30] Foreign Application Priority Data

Apr. 25, 1996 [KR] Rep. of Korea ..... 96-12805

[51] Int. Cl.[6] ..... B65H 7/02; B65H 7/08

[52] U.S. Cl. ..... 271/258.01; 271/110; 271/902; 271/4.03; 271/225

[58] Field of Search ..... 271/110, 902, 271/4.03, 225, 258.01, 252

[56] References Cited

U.S. PATENT DOCUMENTS

| | | | |
|---|---|---|---|
| 3,806,112 | 4/1974 | Melby et al. . | |
| 4,234,833 | 11/1980 | Barrett | 318/282 |
| 4,422,751 | 12/1983 | Komiya et al. . | |
| 4,620,782 | 11/1986 | Kurando et al. | 271/275 |
| 4,621,799 | 11/1986 | Bastow et al. . | |
| 4,731,638 | 3/1988 | Cherian | 355/14 R |
| 4,958,823 | 9/1990 | Iwaki et al. | 271/110 |
| 5,105,229 | 4/1992 | Ozaki | 271/263 |
| 5,507,478 | 4/1996 | Nottingham et al. . | |
| 5,580,046 | 12/1996 | Beaufort . | |
| 5,612,776 | 3/1997 | Machino et al. . | |
| 5,641,157 | 6/1997 | Mays et al. | 271/181 |
| 5,695,038 | 12/1997 | Keith et al. | 194/286 |

FOREIGN PATENT DOCUMENTS

| | | |
|---|---|---|
| 07304235 | 11/1995 | European Pat. Off. . |
| WO 95/19314 | 7/1995 | WIPO . |

*Primary Examiner*—Donald P. Walsh
*Assistant Examiner*—Daniel K Schlak
*Attorney, Agent, or Firm*—Robert E. Bushnell, Esq.

[57] ABSTRACT

A method and apparatus for removing a jammed paper from an ink jet printer is aimed at an efficient removal of the jammed paper. When an operator pulls jammed paper to remove it the feed roller rotates in response to such a motion, and a sensing unit senses a rotational movement of the feed roller and activates a line feed motor, whereby the jammed paper is ejected. The operator has only to pull the jammed paper just a little so as to remove it from the ink jet printer, thereby permitting an efficient removal of the jammed paper and decreasing the chance of tearing of the jammed paper by pulling it too hard which may be a more serious problem than the paper jam itself.

15 Claims, 2 Drawing Sheets

METHOD AND APPARATUS FOR REMOVING A JAMMED PAPER FROM AN INK-JET PRINTER

CROSS REFERENCE TO RELATED APPLICATIONS

This application makes reference to, incorporates the same herein, and claims all benefits accruing under 35 U.S.C. §119 from applications for a Method and Apparatus for Removing a Jammed Paperfrom an Ink-jet Printer earlier filed in the Korean Industrial Property Office on Apr. 25, 1996, and there duly assigned Ser. No. 96-12805.

BACKGROUND OF THE INVENTION

1. Field of the Invention

The present invention relates generally to a method of removing a jammed paper from an ink-jet printer and to an apparatus for executing this method. More particularly, the present invention relates to a method and apparatus involving sensing and displacement of the jammed paper.

2. Description of the Related Art

Printing using an ink-jet printer is carried out on the basis of a carrier transmission and a line feed (LF) of a paper. Among exemplars of contemporary practice on this matter, Beaufortet al. (U.S. Pat. No. 5,580,046, Selective Ejection of Sensed Paper Jams In Single Sheet Paper Processing Equipment, Dec. 3, 1996) discusses determining the type of malfunction, and attempting to self-clear the malfunction. This involves providing an appropriate response to different types of malfunctions. Machino et al. (U.S. Pat. No. 5,612,776, Recording Apparatus And Method With Sheet Feeding Control That Controls Loop, Mar. 18, 1997) discusses counting a loop feed time or the like variably set in accordance with a predetermined sheet feed condition such as the sheet type or particular suppling device. The drive of the sheet feed drive mechanism is controlled by terminating the feeding operation in accordance with a count termination state. A count time of a timer for detecting a feed jam is variably set in accordance with a sheet feed condition such as the sheet material. Komiya et al. (U.S. Pat. No. 4,422,751. Original Feed Control Unit, Dec. 27, 1983) discusses an original feed control unit for a copying machine having a programming means for variably setting a stop position of an original feed device. The position of a detector for detecting a jam of the original may be also varied in accordance with the desired size of the margin in order to properly detect a jam. Nottingham et al. (U.S. Pat. No. 5,507,478, Printing Media Status Sensing, Apr. 16, 1996) discusses a printing media position sensing device. The sheet pick is released upon a signal that the feed mechanism has taken control of the sheet. Bastow et al. (U.S. Pat. No. 4,621,799, Automatic Document Feeder And Registration System Therefor, Nov. 11, 1986) discusses having a long prefeed time to allow for advancing the first original to the preregistration nip to prevent the erroneous declaration of a fault while an initially loaded stack is becoming entrained in the stack feeding elements. Melby et al. (U.S. Pat. No. 3,806,112, Sheet Feeding Apparatus, Apr. 23, 1974) discusses an auxiliary feed roller provided along with a sheet detecting means. The machine can be automatically turned off when a sheet for any reason fails to reach a predetermined point along the path within a desired time interval. We have found that it is not easy to remove a jammed cut sheet of paper from an ink-jet printer by pulling the jammed paper in contemporary designs for printers.

SUMMARY OF THE INVENTION

Therefore, an object of the present invention is to provide an improved method of removing a jammed paper from an ink-jet printer and to provide an apparatus for executing this method.

Another object of the present invention is to provide an improved method and apparatus involving sensing and displacement of the jammed paper.

A further object of the present is to provide an improved method and apparatus involving sensing and displacement of the jammed paper, in which the jammed paper removal is performed with easy such that when the operator pulls the jammed paper to remove it from the printer, a CPU senses any motion of a feed roller in accordance with the displacement of the jammed paper and activates the feed roller to eject the paper.

Another object of the present invention is to provide a method and apparatus in which it is easy to remove a jammed paper from an ink jet printer by sensing any motion of the jammed paper just when an operator pulls the jammed paper and activating an LF motor to enable the feed roller to rotate.

To attain these and other objects, the present invention provides an apparatus and method capable of removing a jammed paper from an ink-jet printer by sensing any motion of the jammed paper just when an operator pulls it and activating the LF motor to enable the feed roller to rotate.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

An ink jet printer typically employs an ink cartridge to print onto a fixed paper conveyed in the printer. When an ink cartridge mounted on the carrier is transferred in a horizontal direction of the fixed paper, the ink in the ink cartridge is jetted in response to the information inputted from a CPU. After one line of printing is finished in this manner, an LF motor is activated to advance the paper by a printed line's interval. When such a paper advance-feeding is finished, the LF motor stops operating. In this state, the ink cartridge is retransferred to a start point of the next line to be printed and the ink-jetting, motor driving, and paper feeding are successively performed in the same manner. The ink-jet printer ejects the printed paper after repeatedly performing such steps until one page of printing has been completed.

In such a procedure, the paper is fed by a paper feeder. Th s paper feeder frequently includes a multistage gear meshing with a driving gear fixed on a rotational shaft of the LF motor the gears reducing rotational movement of the LF motor to a suitable deceleration rate; a feed roller to which motion and power of the LF motor is transmitted by the successively meshing gears in the order of the driving gear, the multistage gear and a driven gear fixed on a rotational shaft thereof, and a friction roller in contact with the feed roller for applying pressure against the paper inserted therebetween. When introduced between the feed roller and the friction roller, the paper receives a rotational force of the feed roller and friction force generated between the paper. These two forces acts as essential factors in the paper feeding step.

However, there is a probability of a occurrence of paper jam when a crumpled paper is fed or an already fed paper is crumpled during printing. Once the paper jam occurs, the LF motor stops operating and it is common that the operator pulls the jammed paper to remove the jammed paper.

Figure 1:
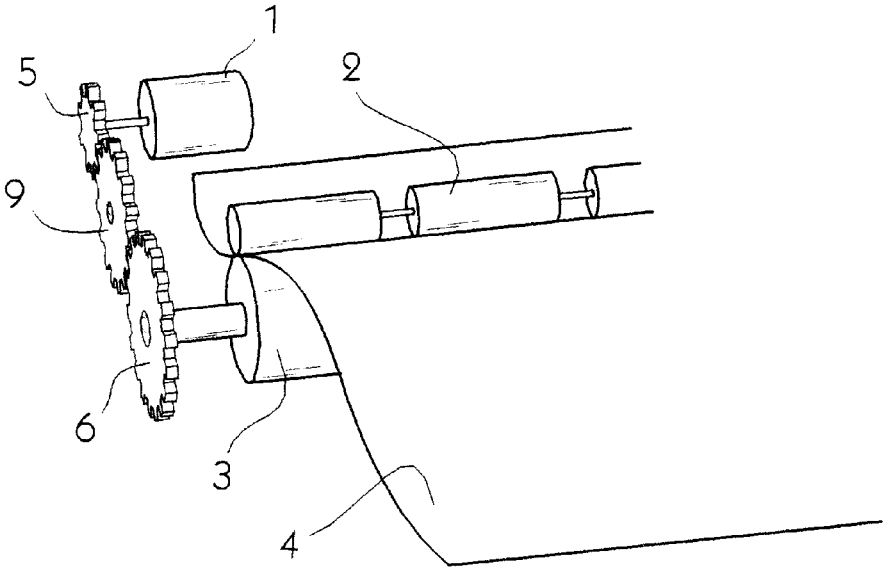
FIG. 1 is a perspective view of a contemporary paper feed of an ink-jet printer.

FIG. 1 shows a contemporary paper feeder. Such a paper feeder employed in an ink-jet printer may be provided with three kinds of gears a driving gear 5 at one end of a rotational shaft of an LF motor 1, a driven gear 6 at an end of a rotational shaft of a feed roller 3, and a multistage gear 9 disposed between gears 5 and 6. On the feed roller 3, a friction roller 2 is rotatably provided in contact with the feed roller 3, pressing the feed roller 3 by means of a spring (not shown).

The driving gear 5 starts rotating simultaneously with the driving of the LF motor. The rotational movement thereof is transmitted to the driven gear 6 through the multistage gear 9, so that the feed roller 3 also rotates. The paper 4 is fed between the feed roller 3 and the friction roller 2 during such movement. The friction roller 2, pressing against the feed roller 3 rotates in a direction opposite to rotational movement of the feed roller 3. In such a printing operation, the most popular used LF motor is a step motor having a rotation resistive force against the outer-oriented rotational movement, i. e. a predetermined detent torque for maintaining a fixed position.

Provided between the driving gear 5 of the LF motor 1 and the driven gear 6 of the feed roller 3, the multistage gear 9 functions as an intermediator for transmitting the driving force of the LF motor 1 to the feed roller 3. It is constituted by a combination of multiple gears each having different steps as suggested by its name, enabling the driving force to be by a constant gear ratio. The motor force increases in proportion to a reduction gear ratio of the multistage gear 9 and the pressure applied to the feed roller 3 from the friction roller 2 functions as a rotation resistive force. For these reasons, when a paper jam occurs, the jammed paper 4 can be removed and the rotation of the feed roller 3 is available only if the paper pulling force by the operator is larger than the total force of the increased detent torque and the pressure applied to the feed roller 3 by the friction roller 2.

Nevertheless, as the paper pulling force is increasing more and more for elimination of the jammed paper 4 and rerotation of the feed roller 3, the jammed paper can easily tear. This can worsen the situation.

Figure 2:
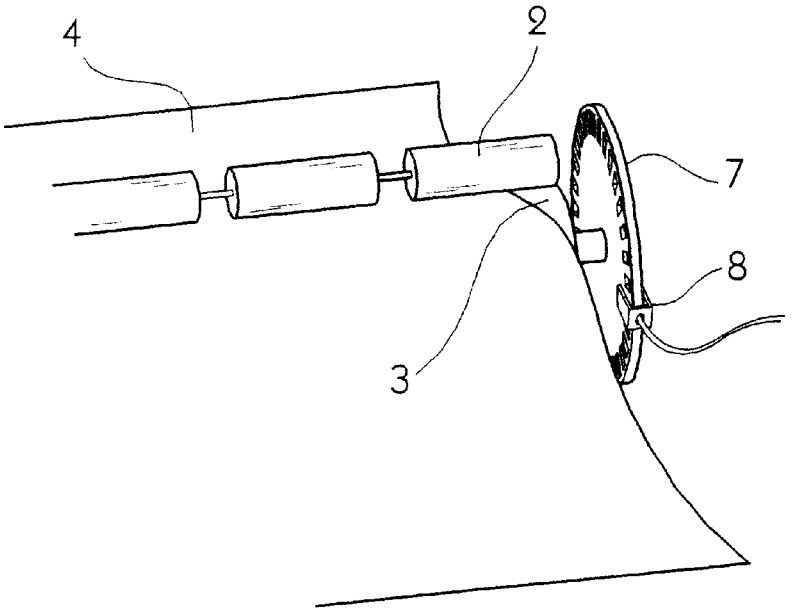
FIG. 2 is a perspective view of a paper feeder employing in improved unit for removing a jammed paper in accordance with the principles of the present invention.

FIG. 2 shows an another approach. As shown in FIG. 2 (showing a schematic perspective view of a paper feeder), a feed roller 3 includes a round plate shaped disk 7 having a plurality of holes disposed at regular intervals and at equal distances from a central point and a photosensor 8 internally fixed to the printer. In the photosensor 8 a transmitter and a receiver mutually exchange a light signal therebetween. A friction roller 2 is further provided on the feed roller 3 to be in contact with the feed roller 3. In such a construction, the photosensor 8 is disposed such that the transmitter and the receiver thereof face each other centering at any point of a circumferential line of the disk 7, the holes being serially formed along the same line.

When the disk 7 rotates, the transmission of the light signal between the transmitter and the receiver is regularly allowed or interrupted, depending on the absence or presence of the hole therebetween. In this fashion, a pulse signal is generated in this; procedure and the photosensor 8 senses the rotational movement of the disk 7 through such pulse signal.

By contrast, when the operator pulls the jammed paper even slightly when a paper jam is occurs, the feed roller 3 starts rotating with the disk 7. Simultaneously, a photosensor 8 senses such a rotation and generates the pulse signal to be delivered to a CPU (central processing unit). A typical implementation of the present invention would have this (CPU in the printer itself. If a CPU of a machine other than the printer is used (e. g., the CPU of the computer attached to the printer), then the implementation would require appropriate computer software and communication protocols. In any implementation, the CPU recognizes that a paper jam has occured by the pulse signal delivered from the photosensor 8 and activates the LF motor 1. Being responsive to rotational movement of the LF motor 1, the feed roller 3 also rotates, so that the jammed paper 4 is ejected and the CPU initializes the printer to execute the printing operation.

Figure 3:
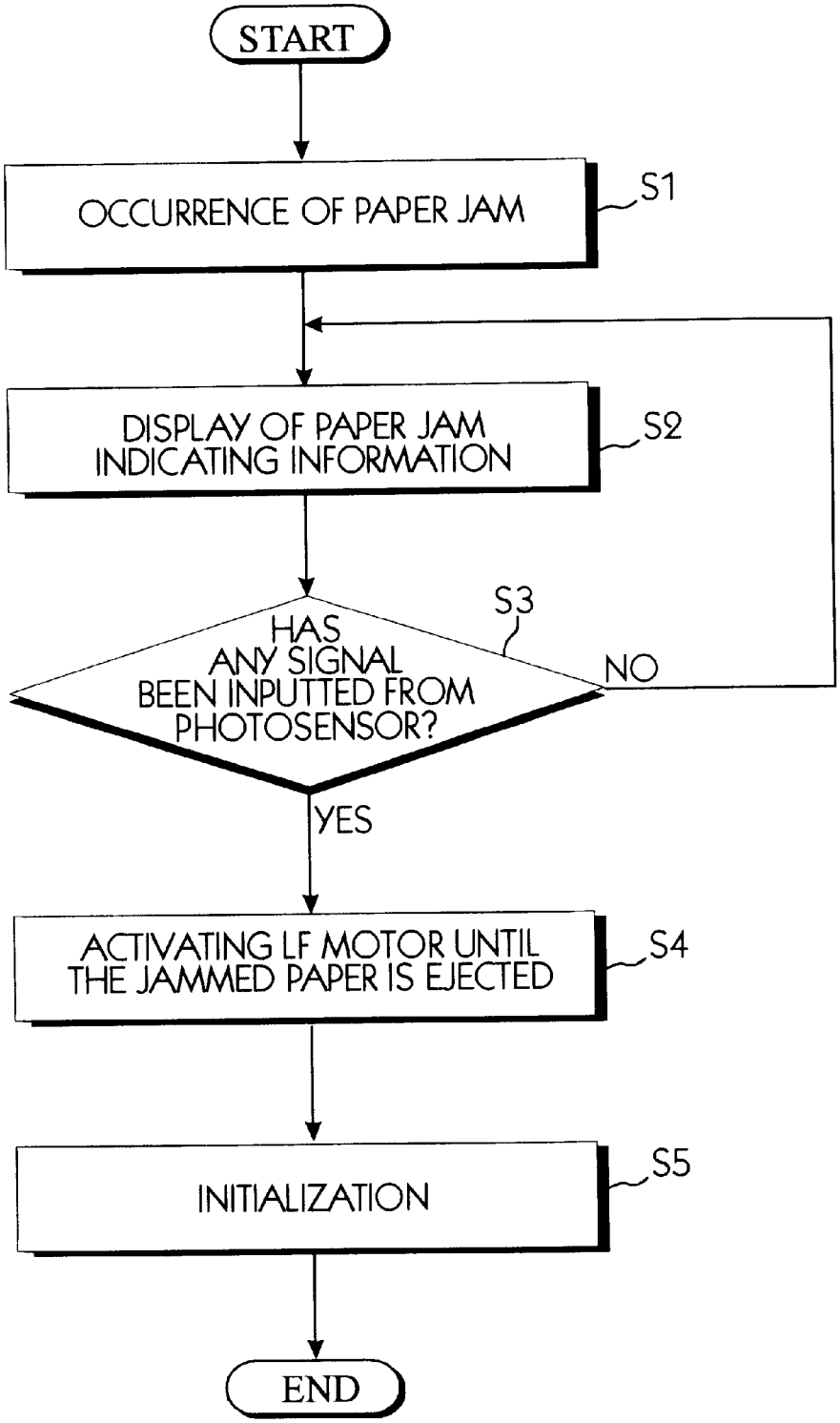
FIG. 3 is a flowchart illustrating an improved method of removing a jammed paper constructed in accordance with the principles of the present invention.

The jammed paper removal is available through the successively followed steps which will be explained below using FIG. 3. Referring to FIG. 3, when a paper jam is occurred (S1), the paper is jam indicating information is displayed on a monitor or the like of the printer (S2). The CPU judges whether or not any pulse signal has been inputted from the photosensor 8 (S3).

If yes, the pulse signal is input from the photosensor 8, then this activates the LF motor until the jammed paper is completely ejected (S4). After the paper ejecting is finished, the CPU initializes the printing mode (S5). By contrast, if no, in step S3 then no signal is input from the photosensor 8 after judgement (S3), and the operation returns to the paper jam indicating step (S2) which will be maintained until a pulse signal is inputted from the photosensor 8.

As mentioned above, the operator has only to pull the jammed paper just a little so as to remove it from the ink-jet printer. Accordingly, efficient removal of the jammed paper is feasible. Also, this decreases a possibility of tearing of the jammed paper by pulling it too hard, which may be a more serious problem more than the paper jam itself.

It will be recognized by those skilled in the art that changes or modifications can be made to the above-described embodiments without departing from tile broad inventive concept of the present invention. It should therefore be understood that this invention is not limited to the particular embodiments described herein but is intended to include all changes and modifications that are within the scope and spirit of the invention as set forth in the following claims.

What is claimed is:

1. An apparatus for removing a jammed paper from a printer, comprising:

a feed roller to transfer a medium having a surface to be printed;

sensing means fixed at one end of a rotational shaft of said feed roller, said sensing means for sensing motion of a jammed paper jammed in the printer when the printer is not printing and for transmitting a sensing signal indicating that the motion has been sensed, said motion generated when an operator pulls the jammed paper, said rotational shaft to rotate said feed roller transferring the medium; and activating means for activating a line feed motor in response to the sensing signal to rotate said feed roller, said line feed motor driving said feed roller, said jammed paper being ejected to outside of the printer upon the line feed motor being activated.

2. The apparatus of claim 1, wherein said sensing means is comprised of:

a round plate shaped disk having a plurality of holes provided at regular intervals and at equal distances from a central point of said round plate shaped disk; and a photosensor located inside a body of the printer, said photosensor transmitting a pulse signal in dependence upon periodically interrupted light passed by said holes when said disk rotates.

3. The apparatus of claim 2, wherein said holes are located serially along a line.

4. The apparatus of claim 2, wherein said feed roller rotates with said disk upon the operator pulling the jammed paper.

5. The apparatus of claim 2, wherein a central processing unit initializes the printer upon the jammed paper being ejected to the outside of the printer.

6. The apparatus of claim 1, wherein said feed roller rotates with said sensing means upon the operator pulling the jammed paper.

7. The apparatus of claim 1, wherein a central processing unit initializes the printer upon the jammed paper being ejected to the outside of the printer.

8. An apparatus for removing a jammed paper from a printer, comprising:

a feed roller to transfer a medium having a surface to be printed;

sensing means fixed at one end of a rotational shaft of said feed roller, said sensing means for sensing motion of a jammed paper jammed in the printer when the printer is not printing and for transmitting a sensing signal indicating that the motion has been sensed, said rotational shaft to rotate said feed roller transferring the medium; and activating means for activating a line feed motor in response to the sensing signal to rotate said feed roller, said line feed motor driving said feed roller, said jammed paper being ejected to outside of the printer upon the line feed motor being activated.

9. The apparatus of claim 2, wherein said sensing means is comprised of:

a round plate shaped disk having a plurality of holes provided at regular intervals and at equal distances from a central point of said round plate shaped disk; and a photosensor located inside a body of the printer, said photosensor transmitting a pulse signal in dependence upon periodically interrupted light passed by said holes when said disk rotates.

10. The apparatus of claim 9, wherein said holes are located serially along a line.

11. The apparatus of claim 9, wherein a central processing unit initializes the printer upon the jammed paper being ejected to the outside of the printer.

12. The apparatus of claim 8, wherein a central processing unit initializes the printer upon the jammed paper being ejected to the outside of the printer.

13. A method for removing a jammed paper from a printer, comprising the steps of:

judging whether a sensing signal of a photosensor is being generated simultaneously with the start of a rotational movement of a disk when an operator pulls a jammed paper to remove the jammed paper from the printer;

when said sensing signal is being generated, activating a line feed motor until the jammed paper is completely ejected to the outside of the printer, said line feed motor driving a feed roller transferring print media; and initiating the printer after the paper is ejected to the outside of the printer.

14. The method of claim 13, further comprising the step of:

indicating information regarding a paper jam by transmitting to a monitor.

15. The method of claim 13, further comprising the steps of:

when said sensing signal is not being generated, indicating information regarding a paper jam by transmitting to a monitor any pulse signal is received from the photosensor.

* * * * *